US005383799A

United States Patent [19]

Fladung

[11] Patent Number: 5,383,799

[45] Date of Patent: Jan. 24, 1995

[54] MULTI-PURPOSE PLUG-IN ELECTRICAL OUTLET ADAPTOR

[76] Inventor: Philip E. Fladung, 1028 Farmview La., Carmel, Ind. 46032

[21] Appl. No.: 37,931

[22] Filed: Mar. 26, 1993

[51] Int. Cl.[6] ..... H01R 25/00

[52] U.S. Cl. ..... 439/652; 439/108; 439/76

[58] Field of Search ..... 439/650–655, 439/76, 108; 29/857, 860, 842, 846, 878

[56] References Cited

U.S. PATENT DOCUMENTS

| | | | |
|---|---|---|---|
| D. 121,820 | 8/1940 | Perl . | |
| D. 195,463 | 6/1963 | Tamarin . | |
| D. 274,808 | 6/1984 | Schwartz . | |
| D. 287,358 | 12/1986 | Schwartz . | |
| D. 315,718 | 3/1991 | Luu . | |
| D. 318,849 | 8/1991 | Luu . | |
| D. 324,029 | 2/1992 | Luu . | |
| 2,506,171 | 5/1950 | Perillo . | |
| 2,510,745 | 6/1950 | Kilgore . | |
| 2,565,075 | 8/1951 | Harcharek | 439/652 |
| 2,611,068 | 9/1952 | Wellens . | |
| 2,619,516 | 11/1952 | Schneider | 439/652 |
| 2,636,096 | 4/1953 | Blasi . | |
| 2,761,112 | 8/1956 | Torcivia . | |
| 2,792,561 | 5/1957 | Cohen . | |
| 2,880,264 | 3/1959 | Ruskin . | |
| 3,018,350 | 1/1962 | Jensen . | |
| 3,163,728 | 12/1964 | Martin . | |
| 3,509,356 | 4/1970 | Peebles . | |
| 3,553,729 | 1/1971 | Tetsuo . | |
| 3,938,068 | 2/1976 | Hagan . | |
| 4,618,196 | 10/1986 | Muzslay | 439/654 |
| 4,767,359 | 8/1988 | Martell . | |
| 4,897,049 | 1/1990 | Miller et al. . | |
| 4,934,962 | 6/1990 | Luu et al. . | |
| 4,954,089 | 9/1990 | Jinsen et al. | 439/76 |
| 4,969,833 | 11/1990 | Lindow et al. . | |
| 5,004,435 | 4/1991 | Jammet . | |
| 5,018,983 | 5/1991 | Bittel et al. | 439/76 |
| 5,094,630 | 3/1992 | Jammet | 439/652 |

FOREIGN PATENT DOCUMENTS 889770 9/1959 United Kingdom .

*Primary Examiner*—David L. Pirlot

[57] ABSTRACT

An multiple outlet adaptor for plug insertion into a conventional wall mounted outlet receptacle, having a main housing defining an interior space a pair of connector blades extending from the rear of the main housing, being spaced apart and arranged in a parallel relationship for insertion into a wall mounted outlet receptacle, a pair of bus carriers mounted within said main housing constructed to accept the connector blades of a conventional plug passing through a pair of apertures in each of the bus carriers, a pair of bus strips positioned for making electrical contact with connector blades inserted into the pair of apertures, a printed circuit board or a pair of tie bars disposed within the interior space housing for electrically connecting the pair of connector blades on the rear of the adaptor housing to the connector blades of a conventional plug inserted into the pair of apertures.

27 Claims, 5 Drawing Sheets

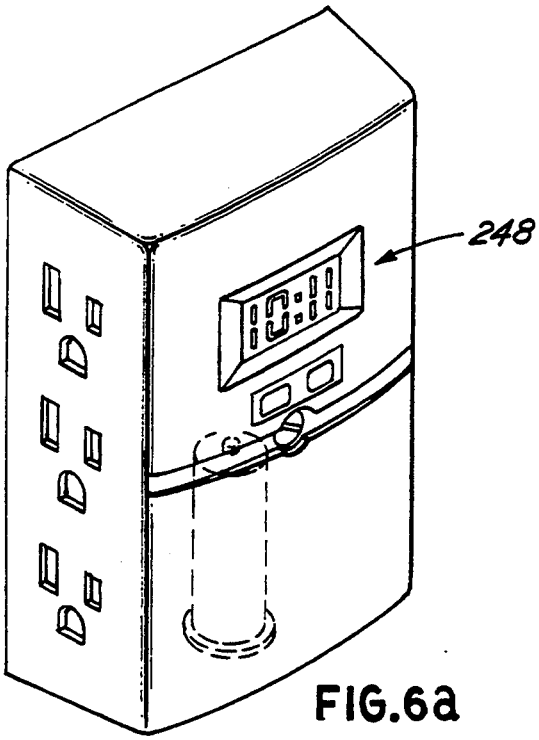
FIG.6a
FIG.6b
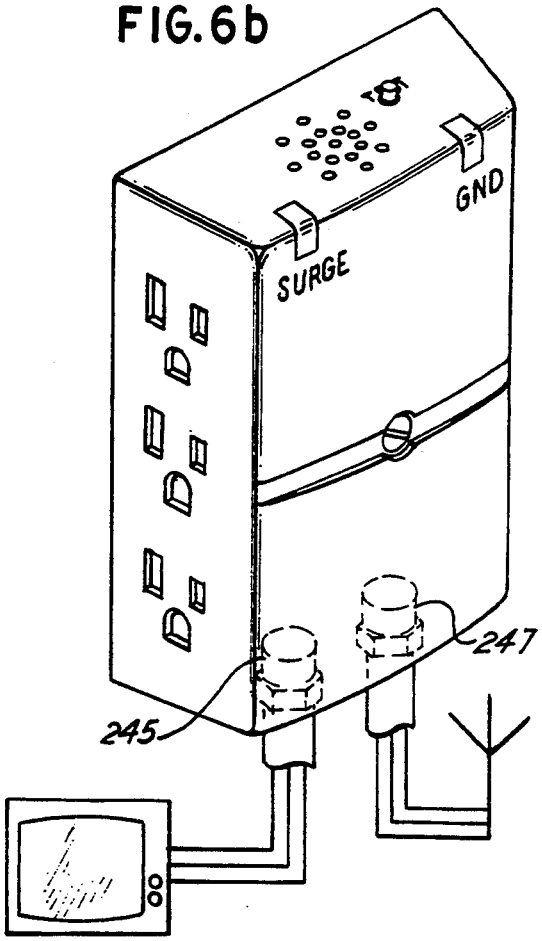
FIG.6c
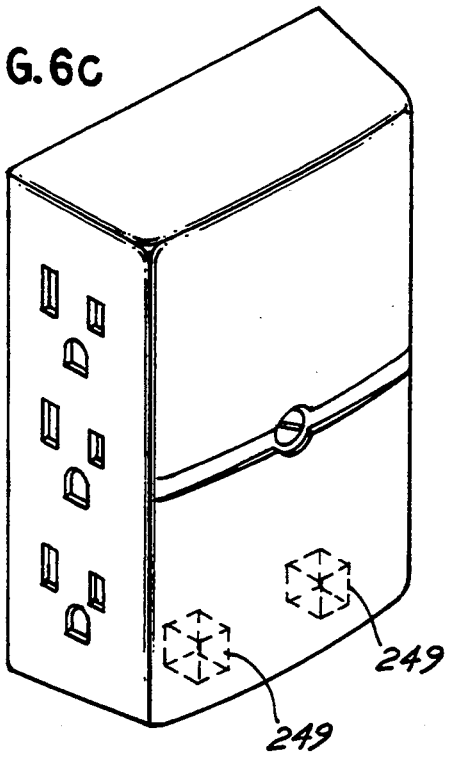
FIG.6d
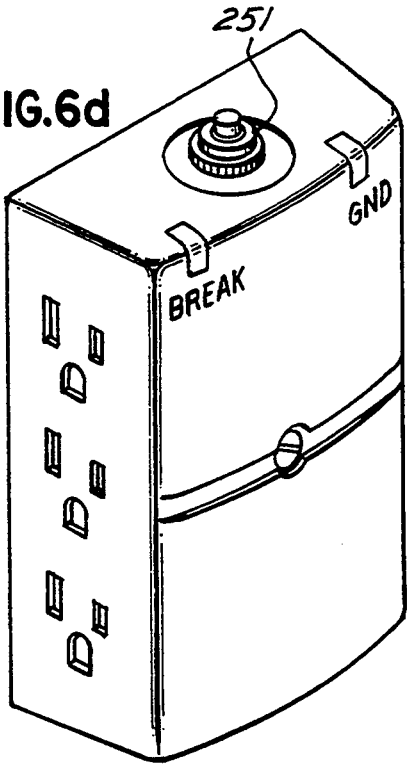

MULTI-PURPOSE PLUG-IN ELECTRICAL OUTLET ADAPTOR

BACKGROUND OF THE INVENTION

This invention relates to multiple electrical plug adaptors designed to be mounted to a standard duplex electrical outlet.

In many applications found in both the home and the office, it is necessary to use plug adaptors to enable the user to connect more than two electrical plugs to a standard duplex electrical outlet. These types of adapters typically engage one or both of the receptacles in a standard electrical outlet. Since the typical outlet is usually surface mounted and substantially flush with the wall or other surface on which it is mounted, any electrical plugs inserted into the outlets, as well as multiple plug adaptors, must extend out from the wall, generally at right angles. This usually results in a multiple plug arrangement that is bulky and occupies considerable volume around the outlet, making it difficult to place furniture, equipment or other objects near the outlet. Also, the accompanying jumble of multiple electrical cords extending from the same outlet is not neat.

In addition to the problems noted above, adaptors presently in use often use a single metal element to form (1) a prong of the multiple-plug adaptor to be inserted into the duplex outlet and (2) the internal electrical contacts used to bring current to the multiple outlets. This can result in an undesirable transference of insertion forces to the unit. Such forces can result in a mechanical failure of the blade or of the electrical contacts within the multiple-plug unit.

Additional problems have been observed as well with prior art units in terms of the ease or difficulty of assembly as a result of their designs.

In many home or business applications it is necessary to use outlet adaptors in connection with various electronic devices of a wide variety. These may include television sets or other items of consumer electronics such as computers, telephones, and the like. In such applications, it may be desirable to use a number of specialized electronic circuits to protect components from damage caused by voltage surges that come from the outside power lines. A common example is the use of electronic noise suppression and line-spike suppressor circuits in conjunction with a multiple-outlet strip. It would be desirable where such a circuit is an integral part of an electrical outlet adaptor designed for direct mounting to a standard duplex outlet. Other circuits, such as a digital clock or a ground-fault circuit interrupter, would also be desirable if incorporated into a device embodying the present invention. Additional applications are possible and will become apparent with the description that follows.

SUMMARY OF THE INVENTION

A side multiple outlet (SMO) adaptor is intended to be attached to a standard duplex electrical outlet. The adaptor can be so attached by removing the cover-plate mounting screw of the duplex outlet, plugging the adaptor into the duplex outlet, and securing the adaptor to the duplex outlet by a longer mounting screw which passes through a centrally-located aperture in the adaptor and engages the threads within the duplex outlet that had previously been engaged by the cover-plate mounting screw. The adaptor may be mounted over the cover plate or with the cover plate removed.

The adaptor includes an external housing having a front panel, two side panels, a top panel and a bottom panel. The side panels of the external housing have a plurality of apertures extending through the side walls that are designed to accommodate the prongs of an electrical plug. The adaptor also has a back plate on which are mounted the electrical components through which electrical connection is made from the outlet into which the adaptor is inserted or plugged. The multiple outlets are accessed from the side panels of the adaptor.

In one embodiment, a plurality of housings are mounted onto the back plate of the adaptor. A plurality of electrically conducting bus bars is located in each of the housings. The bus bars in each of the housings are in electrical connection through a plurality of tie bars. Electrical connection to the source of electrical power within the outlet is made through a plurality of connector blades which extend outwardly through the back panel and into the outlet. The inner ends of these connector blades are connected to rigid connectors that are connected to the bus bars in the housings. Thus, current is brought from the duplex outlet through the connector blades to the tie bars and then to the bus bars in each housing.

In a second embodiment, a printed-circuit board (PCB) is mounted onto the back panel of the adaptor. A pattern of electrical conductors which can accommodate a wide variety of electronic circuits and electrical components is etched onto the printed circuit board. The inner ends of the connector blades are soldered to conductors on the substrate of the printed-circuit board. These conductors lead to connecting tabs extending to the printed-circuit board from the plurality of bus bars within the bus housings of the adaptor. These connecting tabs are in turn soldered to the conductors on the surface of the printed-circuit board.

Additional conductors can bring power from the external circuit of the outlet to electronic circuits or electrical components mounted on the printed circuit board. Among possible circuits or components that may be included on a circuit board of the present invention are surge-suppressor circuits, ground-fault circuit interrupters, coaxial connectors for television-antenna cables, telephone cable jacks, or digital electronic clocks with displays mounted within the external housing of the device.

Additional features and advantages of the invention will become apparent to those skilled in the art upon consideration of the following detailed description of preferred embodiments of the present invention.

Figure 5:
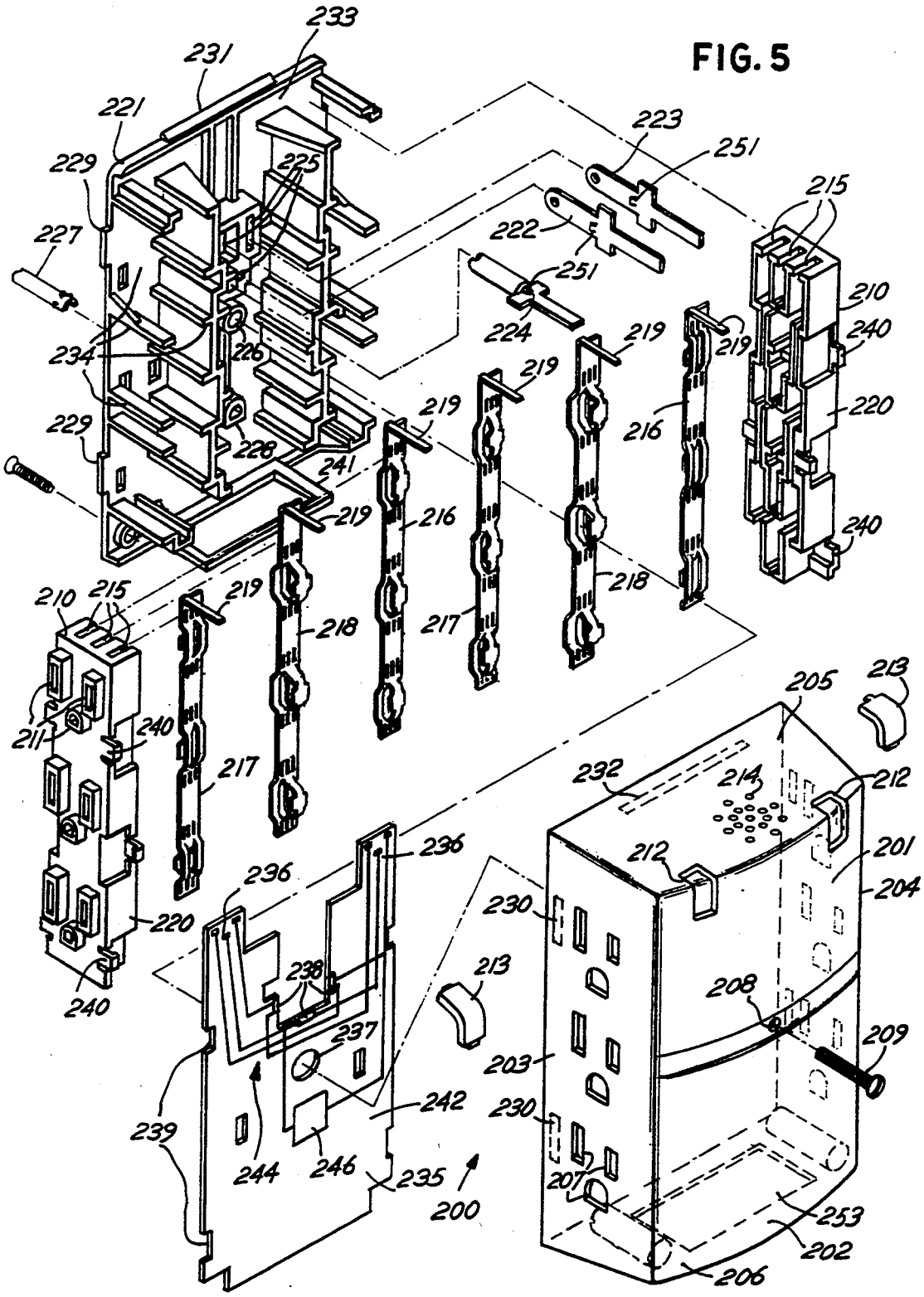
FIG. 5 is an exploded perspective view of a second embodiment of an electrical outlet adaptor.

FIGS. *6a–6d* are perspective views of specific examples of applications possible with the adaptor of FIG. 5.

DETAILED DESCRIPTION OF THE INVENTION

In the following detailed description, terms of spatial orientation are used, such as "left," "right," "top " "bottom," "upward," "downward," and the like. It is to be understood that these terms are used for convenience of description of the preferred embodiments in relation to the drawings.

Figure 1:
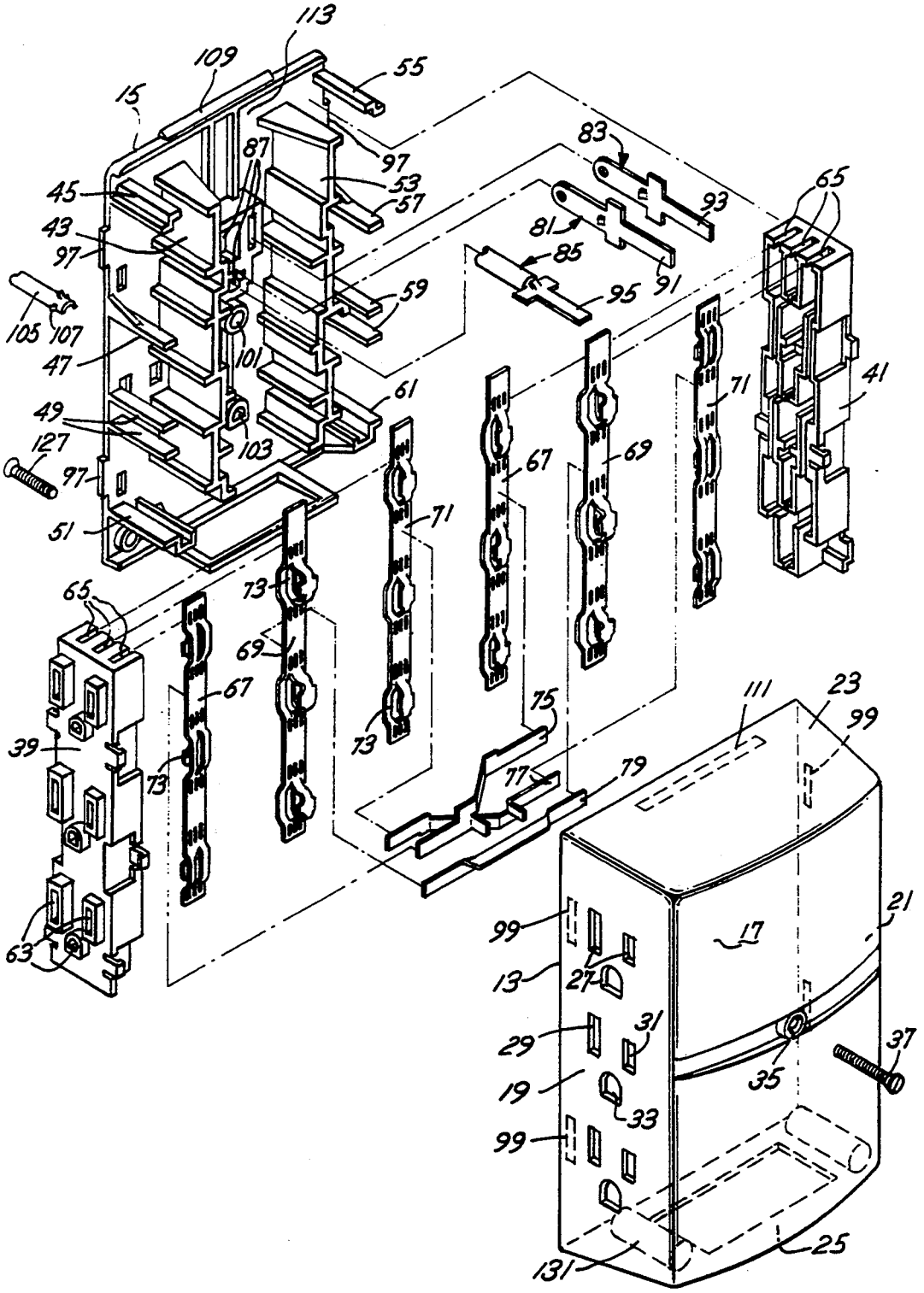
FIG. 1 is an exploded perspective view of an embodiment of an electrical outlet adaptor.

Referring to FIG. 1, an electrical outlet adaptor 11 is generally rectangular in shape and is formed from a front cover 13 and a back panel 15. Cover 13 and back panel 15 define a housing or shell within which electrical conductors or components are mounted.

Cover 13 includes a front panel 17, side panels 19, 21, a top panel 23, and a bottom panel 25. A plug member (formed from a pair of blades 81, 83 and a ground pin 85, as described hereinafter) extends outwardly from the rear of the back panel 15 for plugging the adaptor 11 directly into a conventional electrical duplex wall outlet. Cover 13 and back panel 15 are formed from a plastic, electrically insulative material.

Side panels 19, 21 carry plural sets of plug receiving apertures 27 for receiving the prongs of conventional electrical plugs. The user of adaptor 11 inserts a conventional plug into one set of apertures 27 for connection to power. Three sets of apertures 27 are shown on side panel 13. Each set 27 includes a live or hot prong opening 31, a common prong opening 29, and a ground prong opening 33. Openings 29–33 extend completely through side panels 19, 21. Live prong opening 31 and common prong opening 29 are of different shapes to accommodate the different configurations of the prongs of conventional polarized electrical plugs. This permits the plug to be inserted into the openings in only a single orientation.

Front panel 17 contains a central aperture 35 through which a mounting screw 37 passes. Screw 37 will extend from the backside of the adaptor to engage the threads of a conventional cover-plate mounting hole (not shown) in a standard electrical duplex outlets. The use of mounting screw 37 provides additional mechanical stability for the electrical outlet adaptor 11 after it is plugged into an electrical outlet.

Electrical outlet adaptor 11 includes a pair of symmetrical, bus bar carriers or housings 39, 41 each being formed of a plastic, electrically insulative material. Housings 39, 41 mount within the adaptor and are guided and fixed into position during assembly of the adaptor by a plurality of upstanding wall members 43–51 and 53–61. Housings 39, 41 are generally of unitary construction and contain one or more sets of apertures 63. Apertures 63 align with a respective set of apertures 27 in cover 13 when the housings 39, 41 are fixed into position on back panel 15 and when cover 13 is assembled into position. Each housing 39, 41 includes three alignment grooves or slots 65 designed to accommodate a live bus bar 67, a ground bus bar 69, and a common bus bar 71. Each of the three bus bars 67–71 are stamped from metal and include metallic apertures 73 for receiving in electrical mating contact a plug blade or plug pin which passes into the adaptor through aperture sets 27, 63.

Three metal tie bars 75, 77, 79 are electrically interconnected to respective bus bars 67, 71, 69 in housings 39, 41. Tie bar 77 is connected to the two common bus bars 71; tie bar 75 is connected to the two live bus bars 67; and tie bar 79 is connected to the two ground bus bars 69.

A live metal connector blade 81, a common metal connector blade 83 and a metal ground pin 85 are inserted into apertures 87 which are formed in back panel 15. Connector blades 81, 83 and ground pin 85 are fixed relative to back panel 15 and extend a sufficient distance through the back panel so that blades 81, 83 and pin 85 may be inserted into the openings in a standard three-prong outlet in order to mount the adaptor and conduct electricity. The inwardly-projecting ends 91, 93, 95 of connectors blades 81, 83 and pin 85 are electrically connected to metal tie bars 75–79, preferably by spot welding.

Back panel 15 includes four outwardly extending connector tabs 97 disposed on the outside edges of the back panel as shown. In assembling adaptor 11, tabs 97 are snapped into corresponding slots or grooves 99 formed in the side panels 19, 21 of cover 13. Cover 13 is placed over back panel 15 onto which assembled electrical components and/or conductors are mounted.

Back panel 15 includes a centrally located mounting screw aperture 101 through which mounting screw 37 passes to engage the threads of the corresponding cover screw mounting hole of a standard duplex electrical outlet. Below mounting screw aperture 101 is a second or dummy ground pin aperture 103 designed to accommodate a second ground pin 105. Ground pin 105 does not make electrical connection with any components within the adaptor 11. Ground pin 105 extends into the ground pin aperture of the lower electrical outlet of a standard duplex wall outlet to provide additional mechanical stability for adaptor 11 when it is mounted into place. The inwardly-extending end of ground pin 105 has a plurality of protruding nubs 107. When ground pin 105 is inserted into the aperture 103, the nubs 107 irreversibly engage the inner surfaces of the ground pin aperture 103, serving to hold pin 105 to back panel 15.

Back panel 15 includes a long tab 109 disposed on the top edge of the back panel. Tab 109 is inserted into a corresponding long connector slot or groove 111 formed in the top panel 23 of cover 13. Back panel 15 is molded integrally with upstanding wall members 43–51, 53–61 which extend vertically upward from the floor or inner surface 113 of back panel 15. Wall members 43–51, 53–61 serve as supports to retain bus bar housings 39, 41 into place relative to the back panel 15.

Figure 2:
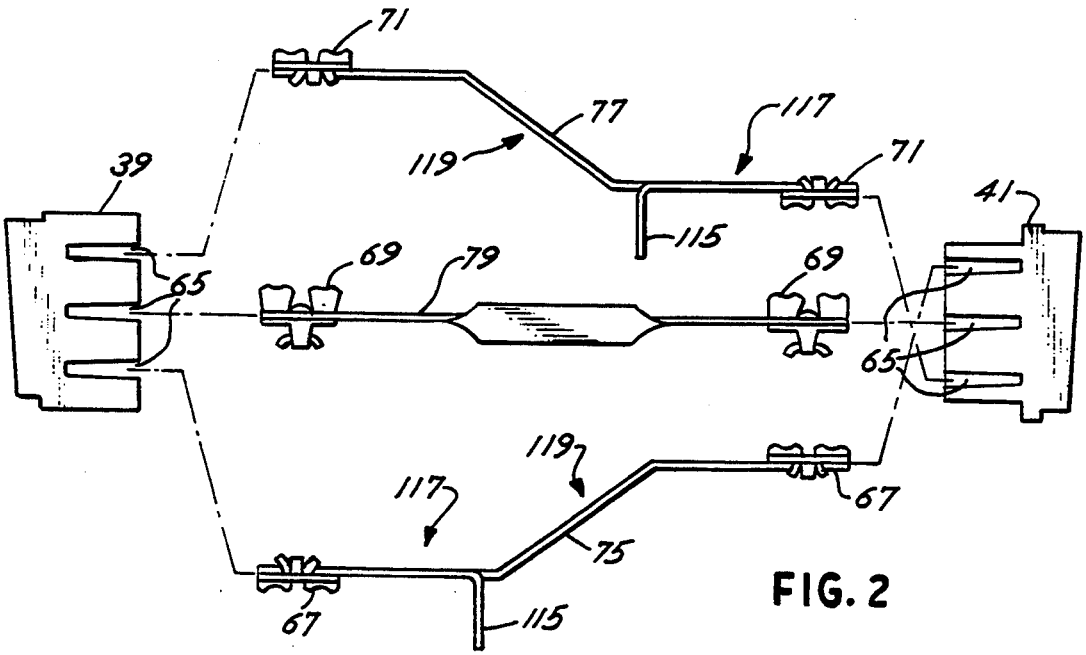
FIG. 2 is a partially exploded top view of the bus bars and tie bars of the adaptor of FIG. 1.

Referring to FIG. 2, each end of blade tie bar 77 is connected to common bus bar 71. Each end of blade tie bar 75 is connected to live bus bar 67. Each end of ground tie bar 79 is connected to a ground bus bar 69. Blade tie bars 75, 77 are essentially identical in configuration; although in the assembled configuration, blade tie bars 75, 77 are oriented 180° to one another. Ground tie bar 79 is essentially straight in overall configuration, having a different configuration from that of blade tie bars 75, 77. Ground tie bar 79 has two orthogonal axes of symmetry.

As shown in FIG. 2, each slot 65 of housings 39, 41 accommodates one of bus bars 67, 69, 71. Slots 65 are oriented vertically within each housing 39, 41. Given the angular shapes of blade tie bars 75, 77, the left-most end of the upper blade tie bar 77 is connected to bus bar 71 which is inserted in the uppermost slot 65 of the left housing 39. The right-most end of the upper blade tie bar 77 is connected to a bus bar 71 which is inserted in the lowest slot 65 of the right housing 41. Upper blade tie bar 77 is, in turn, connected to a connector blade (not shown in FIG. 2), such that each bus bar 71 to which the blade tie bar 77 is connected is also electrically connected to the connector blade.

A connector tab 115 is cut from and bent orthogonally from a portion of each metal blade tie bar 75, 77. Each tab 115 is disposed part way along one of the horizontal sections 117 of the blade tie bar near its intersection with the angled central section 119 of the blade tie bar. Tabs 115 are positioned so that, when assembled, they are adjacent to the inwardly-projecting ends 91, 93 of the connector blades (FIG. 1).

In the orientation of components shown in FIG. 2, which corresponds to the orientation of components within an assembled electrical outlet adaptor 11, the common bus bar 71 in the left housing 39 is inserted in the uppermost slot 65. The live bus bar 71 in the right housing 41 is inserted in the lowest slot 65. Ground bus bars 69 are inserted in the middle slots 65 of the left and right housings 39, 41.

Figure 3:
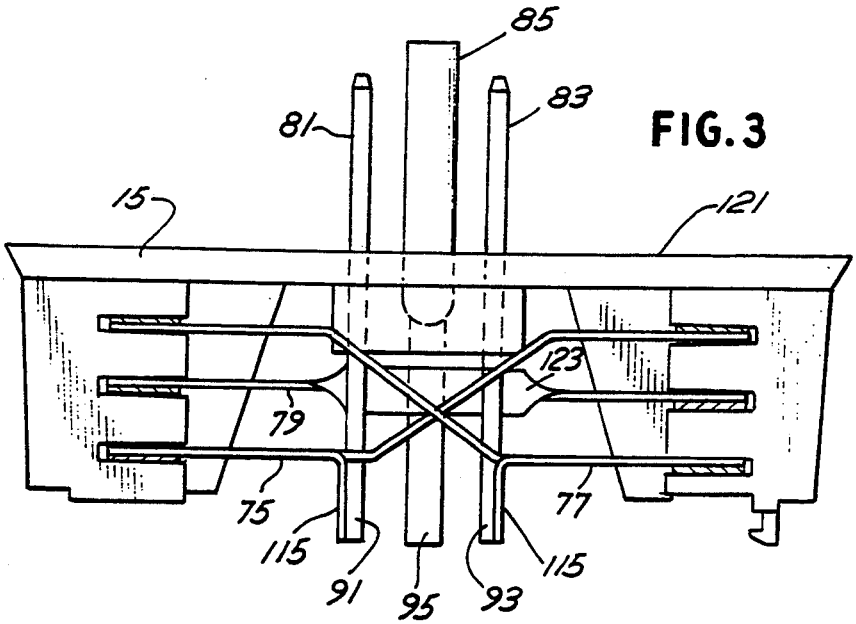
FIG. 3 is a top view of the electrical outlet adaptor of FIG. 1 having the external housing removed.

Referring to FIG. 3, live connector blade 81, common connector blade 83, and ground pin 85 extend outwardly perpendicularly from the rear surface 121 of the back panel 15. These components are also shown extending into the interior of the electrical outlet adaptor 11. In this assembled configuration, the inner end 91 of the live connector blade 81 is aligned directly with the connector tab 115 of tie bar 75; likewise, the inner end 93 of the common connector blade 83 is aligned directly with the connector tab 115 of the common tie bar 77. Similarly, the inwardly-extending end 95 of the ground pin 85 is aligned directly adjacent to and parallel to the flat central portion 123 of the ground tie bar 79. With these components so aligned, connections are made between the adjacent components by spot welding. As understood, blade 81 (the live blade) is preferably positioned on the right and not on the left as viewed in FIG. 3. Typically electrical outlet sockets are wired to receive the live blade of a plug in the right aperture, but of course, may be wired to receive the live blade in the left aperture (as suggested by FIG. 3). If blades 81 and 83 are switched from their positions shown in FIG. 3, then tabs 115 are positioned to engage the appropriate tie bar 75, 77 such that blade 81 is connected to tie bar 75, and blade 83 is connected to tie bar 77.

Figure 4:
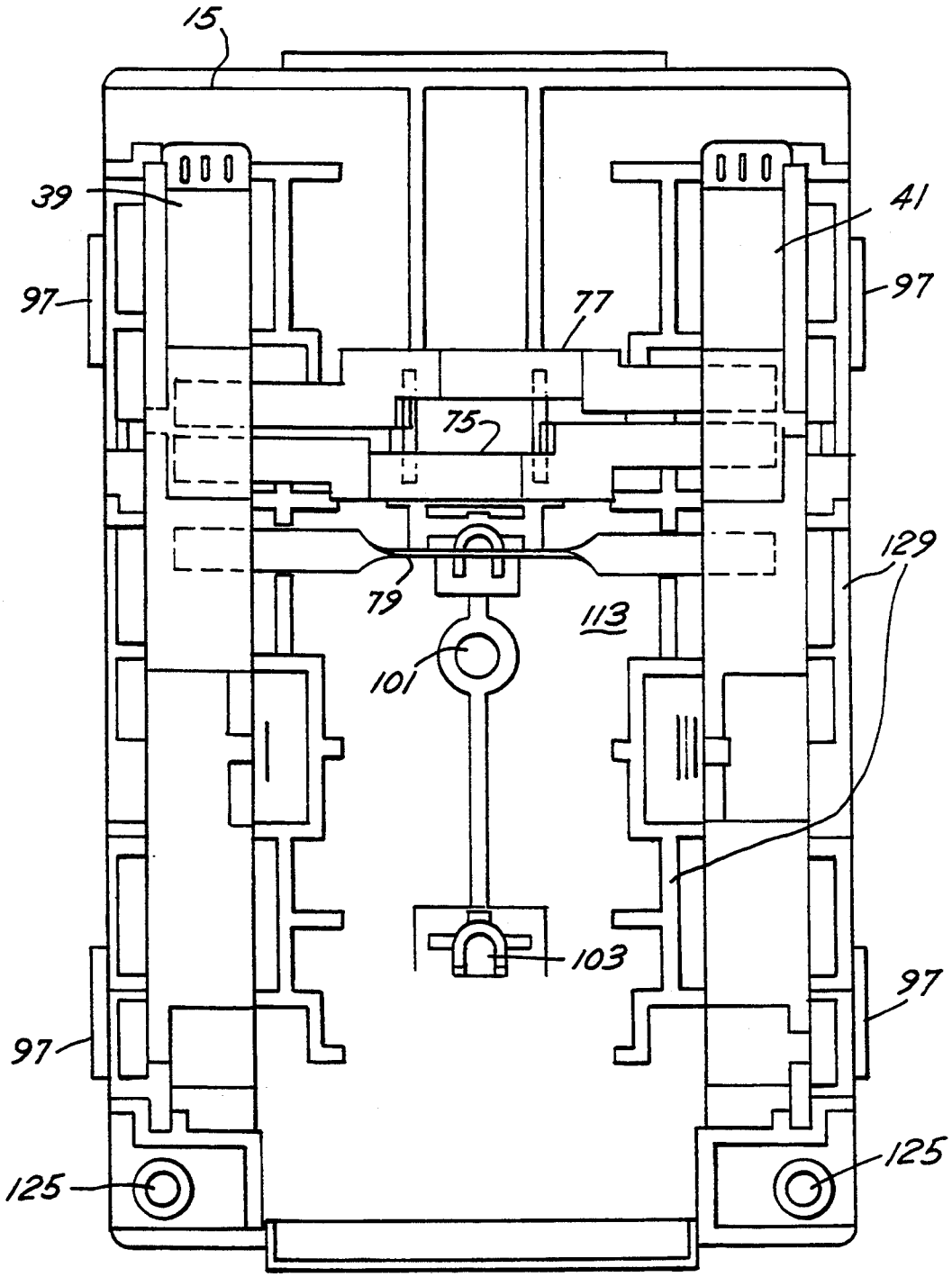
FIG. 4 is a front view of the adaptor of FIG. 1 having the external housing removed.

Referring to FIG. 4, housings 39, 41 are positioned along the left and right sides of the back panel 15. Also visible in FIG. 4 are the live tie bar 75, the common tie bar 77, and the ground tie bar 79. This view illustrates the vertically staggered positioning of the three tie bars 75, 77 and 79 as assembled. Each end of tie bars 75–79 extend inside the respective left and right bus bar housing 39, 41. Not visible in FIG. 4 are the bus bars which are disposed within housings 39, 41 and to which the tie bars 75–79 are connected. Thus, with FIG. 4 and FIG. 3, it can be seen that the tie bars 75–79 are staggered both in the vertical direction, relative to the view of FIG. 4, and the horizontal direction orthogonal to the plane of the back panel 15. FIG. 4 also shows the centrally-located mounting screw aperture 101, the second ground pin aperture 103, and fastener apertures 125 through which fasteners (screw 127, FIG. 1) are inserted to attach the front cover 13 to the back panel 15.

Among the advantages of the present invention are the ease with which the electrical outlet adaptor 11 may be assembled in manufacture and the mechanical stability of the resulting configuration. The assembly process begins with spot welding or otherwise connecting the tie bars 75, 77 and 79 at each end to the bus bars 67, 69 and 71 of FIGS. 1 and 2. To insure maximum mechanical strength of the connection, two spot welds are made between each tie bar end and each bus bar. The bus bars are then individually inserted into slots 65 (FIG. 1) in the housings 39, 41. Next, the live connector blade 81, the common connector blade 83, the ground pin 85, and the second or dummy ground pin 105 (shown in FIG. 1) are inserted into the appropriate apertures in the back panel 15. These are inserted from the direction of the inner surface 113 of the back panel 15 toward the rear of the adaptor. Once these components are in place, i.e., the bus bars, tie bars, and bar housings as assembled in a subassembly, the subassembly is mounted into place on the back panel 15. As can be seen in FIG. 4, there is a plurality of vertical support structures, generally indicated by reference numeral 129 that extend upwardly from the bottom surface 113 of the back panel. These support structures 129 serve as walls to define the position of mounting of the bar housing 39, 41 and to secure the housings into a fixed and stable position. The position of the housings align the plug apertures 63 in the housings with the plug apertures 27 in the cover when the cover is secured to the back panel.

Once the subassembly is mounted into place, the inner ends of the connector blades and pin are welded to the connector tabs and the flat central portion of the rigid tie bars, thus completing the connections necessary to bring electrical current to the multiple plug outlets in the assembled adaptor. At this point, the cover 13 is placed over the entire assembly. The side panels 19, 21 are deformed slightly as the cover 13 is placed in position so that the connector tabs 97 on the back panel 15 can be inserted into the corresponding slots 99 in the cover to further secure the cover to the back panel 15. Fasteners 127 are then inserted through the appropriate apertures 125 (FIG. 4) in the back panel 15 and screwed into threaded receiving holes (not shown) in screw beds 131 of cover 13.

In order to use this embodiment, the central mounting screw of a standard duplex outlet is first removed. The electrical outlet adaptor 11 is then positioned so that the externally-extending ends of the live connector blade 81, the common connector blade 83, the first ground pin 85, and the second or dummy ground pin 105 may simultaneously engage the corresponding openings of the standard duplex outlet. The entire assembly is pushed against the outlet so that the connector blades and ground pins are inserted as fully as possible into the apertures of the outlet, thus making an electrical connection to the duplex outlet. Current is carried from the outlet through the live connector blade 81 to the live tie bar 75 by means of the live connector tab 115. From the live tie bar 75, electrical current flows to the live bus bars 67.

The plug prongs of electrical power cords can then be inserted into any one of the appropriate sets of apertures 27 in the first and second side panels 19, 21 of the cover 13, and into the corresponding bar housings 39, 41. Once the prong of an electrical plug is inserted into the bar housing apertures 63, the plug makes electrical contact with bus bars 67–71 within the housing. This assembly has the advantage that all of its connections between a duplex outlet in the wall and a plug that is inserted in the adaptor are through rigid pieces of metal that are welded together to make a good electrical connection that is strong mechanically.

FIG. 5 is an exploded perspective view of a second embodiment of an electrical outlet adaptor 200 of the present invention. As shown in FIG. 5, this embodiment of an electrical outlet adaptor 200 includes an external housing or cover 201 having a front panel 202, side panels 203 and 204, a top panel 205, and a bottom panel 206. The side panels 203 and 204 contain a plurality of sets of apertures 207 for receiving the prongs of electrical plugs. The front panel 202 contains a central mounting aperture 208 through which a mounting screw 209 extends to engage the threads of the cover screw mounting hole typically found in standard electrical outlets. The top front edge of cover 201 contains two lens apertures 212 designed to accommodate transparent or translucent lenses 213, also shown. Photosensors, indicator lights, etc. may be placed behind the lenses, as understood. In addition, the top panel 205 of cover 201 contains a plurality of holes 214 designed to align with an audio speaker or other sound emitting device (not shown) which may be used in other variations of this embodiment. An alarm test button hole may be provided in top panel 205, through which a test button may protrude. See FIG. 6*b*.

As can be seen from FIG. 5, adaptor 200 also includes a pair of identical bus bar housings 210 which mount in the assembled electrical outlet adaptor 200. These housings 210 are formed of plastic and are essentially identical to the housings 39, 41 used in the first embodiment of the adaptor. The housings 210 contain sets of apertures 211 which align with the apertures 207 in the side panels 203 and 204 of cover 201 when the electrical outlet adaptor 200 is assembled. Each housing 210 includes a plurality of slots 215 designed to contain a live metal bus bar 216, a common metal bus bar 217, and a ground metal bus bar 218, with each of the slots 215 accommodating a single one of the bus bars. The bus bars 216–218 are essentially identical to the bus bars of the first embodiment of the present invention with the exception of the orthogonally extending bus bar connecting tabs 219 located at the top end of the bus bars 216–218. When the bus bars 216–218 are inserted in the slots 215 in the bar housings 210, the connecting tabs 219 extend upwardly above the upper surfaces 220 of the housings.

Adaptor 200 includes a back panel 221. Also included is a live connector blade 222, a common connector blade 223, and a ground pin 224. Each connector blade 222, 223 and the ground pin 224 are inserted into the back panel 221 through back panel apertures 225. The connector blades 222, 223 and the ground pin 224 extend through the back panel 221 and, when mounting the electrical outlet adaptor 200, are inserted into the openings in a standard three-prong outlet to make an electrical connection.

Connector blades 222, 223 and ground pin 224 include metal barbs 251 which serve to grip the back panel when the blades and pin are inserted into place through apertures 225. This adds structure strength and integrity to the unit during plug insertion of the adaptor to relieve pressure on the electrical/mechanical connections made at the interior ends of blades 222, 223 and pin 224, described hereinafter.

The back panel 221 also contains a centrally-located mounting screw aperture 226, designed to align with the corresponding aperture 208 in cover 201. Also shown is a second or dummy ground pin 227, and a corresponding aperture 228 through the back panel 221. The dummy ground pin 227 provides structural support to the adaptor 200 but is not connected electrically in the circuit.

A plurality of outwardly extending connector tabs 229 are positioned on the outside edges of the back panel 221. In assembling the electrical outlet adaptor 200, the tabs 229 are inserted into corresponding connector slots 230 in the side panels 203, 204 as cover 201 is placed over the back panel 221.

The top edge of the back panel 221 contains a long tab 231 which is inserted into a corresponding long connector slot 232 on the top panel 205 of the cover 200. The back panel 221 also contains a plurality of upstanding, wall guide structures 234 extending perpendicular to the bottom inner surface 233 of the back panel. Structures 234 serve as supports to keep the bar housings 210 in place relative to the back panel.

A printed-circuit board (PCB) 235 includes a set of three bus bar connecting tab slots 236 located on each of the upper corners of PCB 235. Slots 236 are designed to accommodate the upwardly extending bus bar connecting tabs 219 when the components are assembled. PCB 235 includes a centrally-located mounting screw aperture 237 designed to allow a mounting screw boss (not shown) to pass through. Directly above the mounting screw aperture 237 is a group of slots or conductor pads 238 designed to accommodate the inwardly-extending ends of the live connector blade 222, the common connector blade 223, and the ground pin 224. PCB 235 also contains two pairs of mounting tab apertures 239 through which corresponding mounting tabs 240 on the top surfaces of the housings 210 are designed to be inserted when the components are assembled.

The back panel 221 also contains a support frame 241 located at the bottom front edge of the back panel 221 and extending outward at right angles from that edge. The frame 241 is designed to accommodate a variety of electronic components when mounted as part of an electronic circuit on the bottom portion of the printed circuit board 235. The bottom panel 206 of cover 201 contains an aperture 253 designed to align with the support frame 241 and permit access to whatever electronic components may be positioned directly above aperture 253 in the assembled device.

Assembly of the electrical outlet adaptor 200 begins with the insertion of live connector blade 222, the common connector blade 223, the ground pin 224, and the second or dummy ground pin 227 into the appropriate apertures 225 and 228. Next, bus bars 216, 217 and 218 are inserted into each of the housings 210. The assembled housings 210 are then mounted on the back panel 221, held in place by the vertically extending structures 234 of the back panel 221. The PCB 235 is then placed into position so that the bus bar connecting tabs 219 and the inwardly-extending ends of the live connector blade 222, the common connector blade 223, and the ground pin 227 extend through the corresponding apertures 236 and 238 in the PCB 235.

The surface 242 of the PCB 235 is etched by standard techniques with a pattern of conductors, the exact design being dependent on the specific electronic circuit, for example circuit 246, to be mounted on the PCB 235. Regardless of the specific circuit to be used, the PCB 235 will have etched on it a pattern that includes conductors 244 leading from the slots 238 (through which the inwardly-extending ends of the live connector blade 222, the common connector blade 223, and the ground pin 224 extend) to the apertures 236 (through which extend the bus bar connecting tabs 219). Each of the tabs 219 is soldered to a conductor on the surface of the PCB 235. These conductors in turn lead to the ends of the live connector blade 222, the common connector blade 223, and the ground pin 224 which are also soldered to the conductors on the surface of the printed circuit board 235. Thus, once the electrical outlet adaptor 200 is mounted in a standard duplex outlet, electrical current can flow from the outlet, through the live connector blade 222, to the conductors 244 on the surface of the PCB 235, and through those conductors to the bus bar connecting tab 219 of each of the live bus bars 216 in each of the housings 210. Appropriate electrical circuit-completing connections are made from the duplex outlet to the electrical outlet adaptor 200 through similar means involving the common connector blade 223, conductors etched onto the surface of the printed circuit board 235, the bus bar connecting tab 219 of the common bus bar 217, and the common bus bar 217 in each housing 210. Ground connections are made in a similar fashion.

At the same time that conductors etched onto the surface of the PCB 235 bring electrical power to the bus bars in each housing 210, conductors also can bring power to whatever electronic circuit 246 or electrical components 246 are to be mounted onto the PCB 235. These circuits or electrical components can, for example, include a line surge protector circuit, with or without an audible or visible alarm, GFCI circuit, circuit breaker circuit, a digital clock circuit, a low-voltage surge protector for a coaxial cable for a television antenna or cable hookup or the like, a low-voltage surge protector for a telephone jack connection, or some combination of one or more of these circuits or components.

FIG. 6*a–d* show a number of specific examples of applications possible with this embodiment of the electrical outlet adaptor 200. FIG. 6*a* is an application involving a digital clock circuit that is on PCB 235 inside the adaptor 200 and controls a digital display device 248 mounted in the cover 201.

FIG. 6*b* is an adaptor 200 including coaxial connectors 245, 247 for the input and output of a cable that is taken to an overvoltage suppressor in the adaptor 200. Such an adaptor 200 provides protection against voltage spikes for the antenna of a television set, a computer, or the like. This adaptor 200 includes a surge suppressor located on the PCB along with a circuit to drive an audible alarm.

FIG. 6*c* shows an adaptor 200 having a surge suppressor for telephone jack connectors 249 mounted in the housing 201. An application involving a circuit-breaker 251 is shown in FIG. 6*d*. As will suggest itself, an adaptor may be made for a two-prong electric plug, and therefore may not have a socket for a ground lug. These and other useful applications are possible because of the versatility of the PCB in the adaptor 200; the applications themselves are well known and are therefore not illustrated further. The applications and the operation of the adaptor 200 are particularly facilitated by the structure that provides paths for line current only through blades, solid bus bars, conducting paths on a PCB, and welded or soldered connections among these.

Although the invention has been described in detail with reference to the illustrated preferred embodiments, variations and modifications exist within the scope of the invention as described and as defined in the following claims.

I claim:

1. An outlet adaptor for plug insertion into a conventional wall mounted outlet receptacle, said adaptor comprising:

a main housing defining an interior space first and second connector blades securely mounted to said main housing, each of said blades having an exterior end extending outwardly from the backside of said main housing and an interior end disposed within said interior space, said exterior ends of said connector blades being spaced apart and arranged in a parallel relationship to define a plug capable of insertion into a wall mounted outlet receptacle;

a first bus carrier associated with said main housing having a first set of plug receiving apertures and constructed to accept the connector blades of a conventional plug passing through first and second apertures of said first set of apertures, said first bus carrier including a first bus strip positioned for making electrical contact with a connector blade inserted into said first aperture of said first set of apertures, and a second bus strip positioned for making electrical contact with a connector blade inserted into said second aperture of said first set of apertures;

a second bus carrier associated with said main housing having a second set of plug receiving apertures and constructed to accept the connector blades of a conventional plug passing through first and second apertures of said second set of apertures, said second bus carrier including a third bus strip positioned for making electrical contact with a connector blade inserted into said first aperture of said second set of apertures and a fourth bus strip positioned for making electrical contact with a connector blade inserted into said second aperture of said second set of apertures;

a printed circuit board disposed within said interior space, said printed circuit board carrying a plurality of printed electrical conductors; and each of said first, second, third and fourth bus strips being electrically connected to one of said printed electrical conductors of said printed circuit board and the interior end of each of said first and second connector blades being electrically connected to one of said printed electrical conductor of said printed circuit board.

2. An adaptor according to claim 1 wherein said printed circuit board includes first and second oppositely disposed sides and a central region, each of said sides including a peripheral area; and wherein said printed circuit board includes (i) first electrical connecting points located in the peripheral area of said first side, (ii) second electrical connecting points located in the area of said second side, and (iii) third electrical connecting points located in said central region; and wherein said printed electrical conductors carried by said printed circuit board connects one of said first connecting points to one of said second connecting points and to one of said third connecting points, and wherein said printed electrical conductors carried by said printed circuit board connects another of said first connecting points to another of said second connecting points and to another of said third connecting points.

3. An adaptor according to claim 1 wherein said first bus carrier has first and second openings constructed to accept the connector blades of a conventional plug passing through said first and second apertures of said first set of apertures and wherein said second bus carrier has first and second opening constructed to accept the connector blades of a conventional plug passing through said first and second apertures of said second set of apertures.

4. An adaptor according to claim 1 wherein said connector blades define an insertion axis; and wherein said housing includes a back support member having a rear, generally flat planar surface, defining a first plane orthogonal to said insertion axis; and wherein said printed circuit board is secured within said interior relative to said back surface in a second plane substantially parallel to said first plane.

5. An adaptor according to claim 4 and further including support alignment structures upstanding from said back support member; and where said printed circuit board is connected to said support structures for stabilizing said printed circuit board relative to said back support member.

6. An adaptor according to claim 1 wherein each of said bus strips is formed from a single metal piece, each of said strips including a rigid connector arm, each said connector arm being joined in electrical and mechanical connection with said printed circuit board.

7. An adaptor according to claim 6 wherein each of said bus strips has a substantial planar portion and wherein said connector arm is bent perpendicularly from said substantial planar portion.

8. Apparatus according to claim 6 wherein said printed circuit board includes a plurality of connector apertures, and wherein each of said connector arms is disposed within one of said apertures for providing mechanical and electrical connections.

9. An adaptor according to claim 1 wherein said printed circuit board includes a plurality of connector surfaces disposed between the top side and bottom side of said printed circuit board, one of said connector surfaces being electrically connected with the interior end of one of said connector blades, and another of said connector surfaces being electrically connected with the internal end of another of said connector blades.

10. An adaptor according to claim 9 wherein said connector surfaces being located in a central region of said printed circuit board.

11. An adaptor according to claim 9 wherein said interior ends of said connector blades includes a flat planar surface, disposed in mating contact with one of said connector surfaces carried by said printed circuit board.

12. An adaptor according to claim 9 wherein said connector surface is formed of a central edge defined by a cut away portion of the central area of said printed circuit board.

13. An adaptor according to claim 1 wherein printed circuit board carries an electrical circuit, and wherein said some of said printed electrical conductors carried by said printed circuit board are electrically interconnected with said circuit.

14. An adaptor according to claim 13 wherein said printed electrical conductors connected with said circuit provide a circuit for current from a said connector blade.

15. The adaptor of claim 13, wherein said electrical circuit is a surge suppressor circuit.

16. The adaptor of claim 13, wherein said electrical circuit is a ground fault detector circuit.

17. An adaptor according to claim 1 wherein said printed circuit board includes first and second connector apertures disposed in the peripheral area at the top of said side areas of said printed circuit board.

18. An adaptor according to claim 17 wherein said bus carriers are formed of a plastic nonconductive material, said bus carriers having a first longitudinal receiving groove within which a first bus strip is mounted, and a second longitudinal receiving groove in which a second bus strip is mounted, said first and second bus strips being mounted relative to said first set of connector apertures for making electrical contact with the printed circuit board.

19. An adaptor according to claim 18 wherein said grooves of said bus carriers extending through at least one end thereof and providing groove openings, said bus strips extending outwardly from said groove openings to provide electrical connection with said printed circuit board.

20. An adaptor according to claim 1 wherein said main housing is formed from a plastic insulated material, said main housing including a back member and a front member, said front member defining a one piece cover having a front panel, two side panels, a top panel, and a rear panel, said first set of apertures being formed in one of said side panels and said second set of apertures being formed in the other of said side panels.

21. An adaptor according to claim 20 wherein said back member and said front member each include a screw aperture aligned for receiving a screw.

22. An adaptor according to claim 20 wherein said front member includes at least one aperture;

and wherein said adaptor further includes a lens member fixedly positioned within said one aperture.

23. An adaptor according to claim 22 and further including a visual indicator within said interior of said main housing relative to said lens member for passing light through said lens member; and wherein said printed circuit board provides electrical current to said visual indicator.

24. An adaptor according to claim 22 and further-including a photosensor disposed within said interior of said main housing relative to said lens member for receiving light passing through said lens member; and electrical circuitry carried by said printed circuit board, said photosensor transmitting an electrical signal to said electrical circuitry.

25. The adaptor of claim 13, wherein said electrical circuit is a digital clock circuit.

26. The adaptor of claim 25, and further comprising a digital clock display mounted on said housing and operatively connected to said digital clock circuit.

27. A method for assembling a multiple outlet adaptor intended for attachment to an electric outlet, said method comprising the steps of:

A. providing a housing, at least two bus bars having tabs for receiving a printed circuit board, at least two connector blades, and a printed circuit board comprising at least two conductors supported on a substrate, said printed circuit board having locations for receiving said tabs and said connector blades adjacent to said conductors;

C. assembling said housing, said bus bars, and said connector blades in their operative positions, with portions of said tabs and said connector blades disposed in a single plane;

B. after said assembling step, disposing said printed circuit board in its operative position coinciding with said single plane; and C. electrically connecting the respective said bus bars and the respective said connector blades to the respective said conductors.

* * * * *